United States Patent [19]

Wunderlich

[11] 4,402,707

[45] Sep. 6, 1983

[54] DEACTIVATING DRIED COAL WITH A SPECIAL OIL COMPOSITION

[75] Inventor: Donald K. Wunderlich, Richardson, Tex.

[73] Assignee: Atlantic Richfield Company, Los Angeles, Calif.

[21] Appl. No.: 333,137

[22] Filed: Dec. 21, 1981

[51] Int. Cl.[3] ..... C10L 9/10
[52] U.S. Cl. ..... 44/6; 44/1 G
[58] Field of Search ..... 44/6, 1 R, 1 G, 2

[56] References Cited

U.S. PATENT DOCUMENTS

| | | | |
|---|---|---|---|
| 1.886,633 | 11/1932 | Broeman | 44/6 |
| 2,098,232 | 11/1937 | Fife | 44/6 |
| 3,985,516 | 10/1976 | Johnson et al. | 44/6 X |
| 4,201,657 | 5/1980 | Anderson et al. | 44/6 X |

*Primary Examiner*—Carl F. Dees
*Attorney, Agent, or Firm*—M. David Folzenlogen

[57] ABSTRACT

Mined, crushed, dried coal particles are sprayed with a special deactivating oil to reduce the tendency of the dried coal to spontaneously ignite. The special oil is a virgin vacuum reduced crude with a 5% point above 900° F., a characterization factor of 10.8 or greater, and a minimum flash point of 400° F.

6 Claims, 3 Drawing Figures

DEACTIVATING DRIED COAL WITH A SPECIAL OIL COMPOSITION

BACKGROUND OF THE INVENTION

This invention relates to improved methods for producing a dried particulate coal fuel having a reduced tendency to spontaneously ignite. More particularly, dried coal is sprayed with a special high flash point virgin vacuum reduced crude having a characterization factor above 10.8 and a 5% point in excess of 900° F.

In many instances, coal as mined contains undesirably high quantities of water for transportation and use as a fuel. This problem is common to all coals although it is less severe in high grade coals, such as anthracite and bituminous coals. Attempts to dry crushed mined coals before shipment or storage have been inhibited by the tendency of such coals after drying to undergo spontaneous ignition and combustion in storage, transit or the like. As a result, a continuing effort has been directed to the development of improved methods whereby coals, especially low grade coals, such as sub-bituminous, lignite, and brown coals can be more than merely surface dried and thereafter safely transported, stored, and used as fuels.

In this regard, it has been previoulsy proposed to spray dried coal with hydrocarbons; but such oils are unsuitable for several reasons. For example, U.S. Pat. No. 4,201,657 proposes a blend of nonvirgin aromatic and asphalt hydrocarbons having a characterization factor no higher than 10.5 and preferably about 10.1 and a relatively low flash point and five percent point.

SUMMARY OF THE INVENTION

Dried crushed mined coal particles are sprayed with a special oil composition having the desired deactivation properties while being relatively low in carcinogenic properties. The special oil is a virgin vacuum reduced crude with a 5% point in excess of 900° F., a characterization factor of 10.8 or greater, and a minimum flash point of 400° F. or greater. The process is especially useful to gas dried sub-bituminous, lignite and brown coals having a moisture content of less than 10 to 15% by weight.

DETAILED DESCRIPTION OF THE INVENTION

Figure 1:
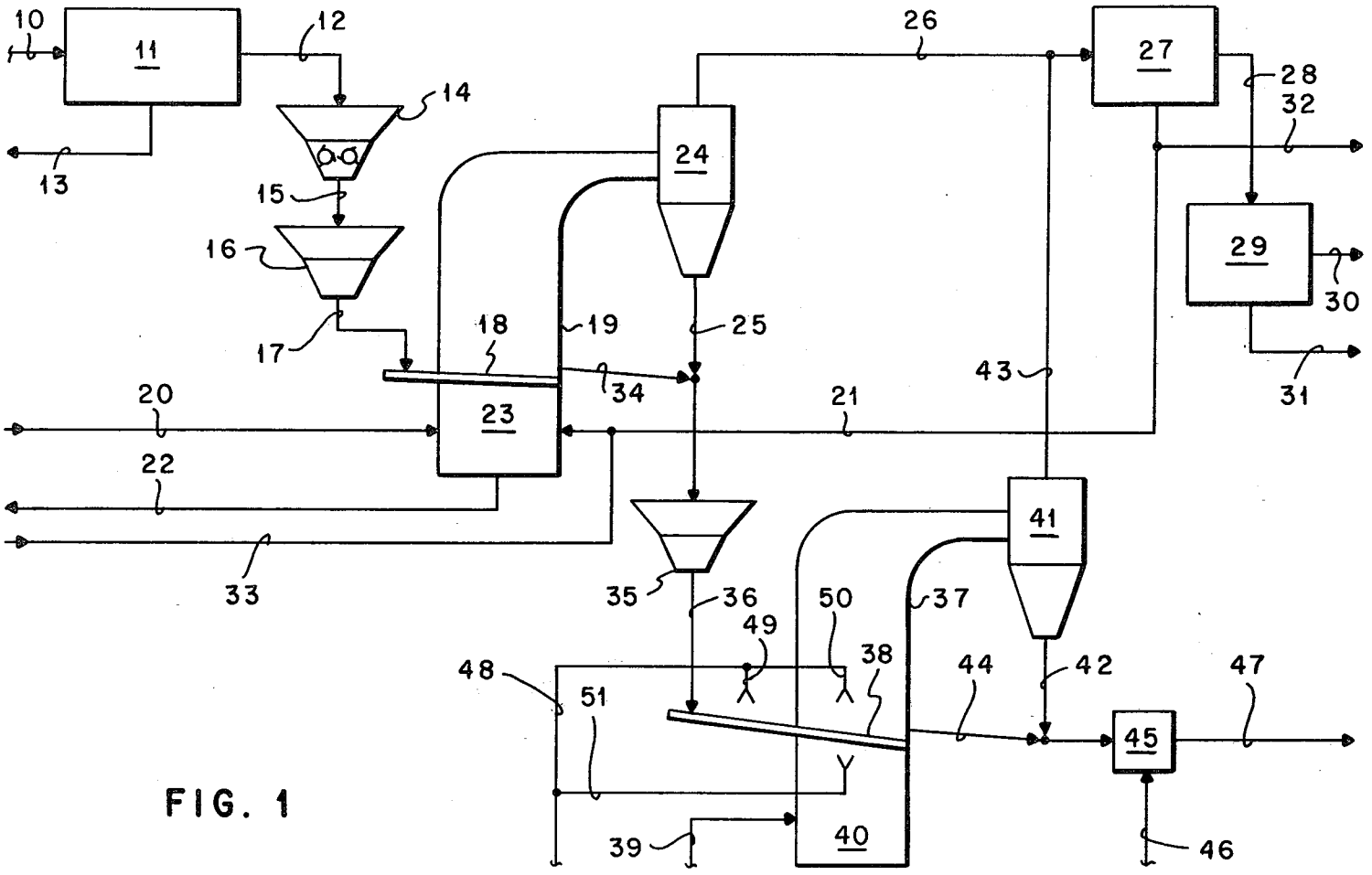
FIG. 1 is a schematic diagram of a coal drying process to which the method of this invention may be applied.

This invention is an improved method of reducing the tendency of dried coal to spontaneously ignite. Coals may be dried to remove surface water or deep dried to remove interstitial water and thereby increase the heating (BTU) value of the coal. In this description, dried coal is coal that has been dried to remove some of the interstitial water and the moisture content of a dried coal is measured in accordance with the procedures set forth in ASTM D3173-73, entitled "Standard Test Method for Moisture in the Analysis Sample of Coal and Coke," published in the 1978 Annual Book of ASTM Standards, Part 26. The method of this invention is applicable to all forms of dried coal especially deep dried coal; but is especially useful for dried low grade coals, such as sub-bituminous, lignite and brown coals.

In the method, dried coal particles are sprayed with a special deactivating oil composition having in combination four characteristics, the special oil is comprised of a virgin vacuum reduced crude oil having a minimum characterization factor of 10.8, a minimum flash point of 400° F., and a 5% point above 900° F.

The term flash point is well known and will not be further described.

It is important to note that the special deactivating oil composition is obtained by vacuum reducing virgin crude oil under conditions such that the five percent point is above 900° F. Virgin crude oil is an oil or oil cut as produced from a petroleum reservoir and that has not been subjected to any appriciable thermal treatment that would produce cracked material.

The special oil composition is obtained by vaccuum reduction of crude oil under conditions such that the five percent point is above 900° F. as determined from test values obtained on virgin crude oil in accord with the procedures described in ASTM D1160-77, entitled "Standard Method for Distillation of Petroleum Products at Reduced Pressures", published in the 1978 Annual Book of ASTM Standards, Part 23. For example, crude oils were vacuum reduced at different cut points ranging between 600° F. and 1000° F. and then applied to dried coal. The oxidation rate constants before and after applying the reduced oil were measured. In general, it was found that at 600° F., the degree of deactivation was unsuitable, and that at 800° F., the degree of deactivation was only marginally successful at best; but that at 1000° F., the oil was fully satisfactory.

The characterization factor is a special physical property of hydrocarbons defined by the relationship:

$$K = \frac{T_b^{\frac{1}{3}}}{G}$$

where

K – Characterization factor $T_b$ = Cubic average boiling point °R.

G = Specific gravity 60° F./60° F.

°R = °F. + 460.

The cubic average boiling point is determined in accordance with the calculations mentioned in an article entitled "Boiling Points and Critical Properties of Hydrocarbon Mixtures," by R. L. Smith and K. M. Watson, appearing in Industrial and Engineering Chemistry, Volume 29, pages 1408–1414, December, 1937, and using the ten, thirty, fifty, seventy, and ninety percent points °F. as measured by the procedures of ASTM D1160-77, previously described or ASTM D86 entitled "Standard Method for Distillation of Petroleum Products", published in the 1978 Annual Book of ASTM Standards, Part 23. ASTM D86 is for products which decompose when distilled at atmospheric pressure.

A difference of a few tenths in characterization factor may seem small; but this factor is readily determined to an accuracy of 0.1 and it can be used and interpreted with considerable confidence and reliability. This factor is useful is identifying hydrocarbons. For example, materials with a characterization factor of 9.5 are pure polynuclear aromatics called PNA which are highly carcinogenic substances. On the other end of the scale, materials with a chracterization factor of 13 are pure paraffins like innocuous vaseline. The characterization factor correlates well with many other physical properties of an oil, such as, molecular weight, viscosity, thermal expansion, specific heat, critical properties, heat of combustion, and the like.

The drawings illustrate one of the many types of processes to which this invention is applicable. In the drawings, reference will be made to lines generally rather than attempting to distinguish between lines as conduits, conveyors or the like and like equipment will be given the same number.

Accordingly, a run of mine coal stream is charged through a line 10 to a coal cleaning or preparation plant 11 from which a coal stream is recovered through a line 14 with a waste stream comprising gangues and the like being recovered and passed to discharge through a line 13. In some instances, it may not be necessary to pass the run of mine coal to a coal cleaning or processing plant prior to charging it to the process of the present invention, although in many instances, such may be desirable. The coal stream recovered from preparation plant 11 through line 12 is passed to a crusher 14 where it is crushed to a suitable size and passed through a line 15 to a hopper 16. While a size consist less than about two inches, i.e. two inches by zero may be suitable in some instances, typically a size consist of about one inch by zero or about three-quarters inch by zero will be found more suitable. The particulate coal in hopper 16 is fed through a line 17 to a moving grate, slotted grate, rotating drum, revolving screen, spinning grill, expanded bed, fluidized bed, semifluidized bed, or the like 18 in a dryer 19. In dryer 19, the coal moves or is moved at a rate determined by the desired residence time in dryer 19. A hot gas is passed upwardly through the coal in dryer 19 to dry the coal. In the drawing, the hot gas is produced by injecting air through a line 20 to combust a stream of coal fines injected through a line 21. The combustion of the coal fines generates hot gas at a temperature suitable for drying the coal. As will be obvious to those skilled in the art, the temperature can be varied by diluting the air with a non combustible gas, by the use of alternate fuels, by the use of oxygen enriched streams or the like. Clearly, alternate fuels, i.e. liquid or gaseous fuels could be used instead of or in addition to the finely divided coal, although it is contemplated that in most instances, a stream of finely divided coal will be found most suitable for use as a fuel to produce the heated gas. Ash is recovered from dryer 19 through a line 22. A combustion zone 23 may be appropriately located in dryer 19 to permit the production of the hot gas, although it will be readily understood that the combustion zone or hot gas could be produced outside dryer 19. The exhaust gas from dryer 19 is passed to a cyclone 24 where finely divided solids, typically larger than about 100 Tyler mesh, are separated from the exhaust gas and recovered through a line 25. The exhaust gas, which may still contain solids smaller than about 100 Tyler mesh, is passed through a line 26 to a fine solids recovery section 27 where finely divided solids, which will typically consist primarily of finely divided coal are recovered through line 21 with all or a portion of the finely divided coal being recycled back to combustion zone 23. The purified exhaust gas from fine solid recovery section 27 is passed through a line 28 to a gas cleanup section 29 where sulfur compounds, light hydrocarbon compounds, and the like are removed from the exhaust gas in line 28, as necessary to produce a flue gas which can be discharged to the atmosphere. The purified gas is discharged via a line 30 with the contaminates recovered from the exhaust gas being recovered through a line 31 and optionally passed to a flare, a wet scrubber or the like. The handling of the process gas discharge is not considered to constitute a part of the present invention, and the cleanup of this gaseous stream will not be discussed further. The fine coal stream recovered through line 21 may in some instances constitute more coal fines than are usable in combustion zone 23. In such instances, a fine coal product can be recovered through a line 32. In other instances, the amount of coal fines recovered may not be sufficient to provide the desired temperature in the hot gas used in dryer 19. In such instances, additional coal fines may be added through a line 33.

The dried coal product recovered from dryer 19 is recovered via a line 34 and combined with the solids recovered from cyclone 24 through line 25 and passed to a hopper 35 from which dried coal is fed via a line 36 to a cooler 37. Cooler 37 includes a moving grate, slotted grate, rotating drum, revolving screen, spinning grill, or the like 38 on which the dried coal is supported as it passes through cooler 37. In cooler 37, a cool gas is introduced through line 39 into a distribution chamber 40 beneath the hot coal and is passed upwardly through the dried coal to cool the dried coal. The exhaust gas from cooler 37 is passed to cyclone 41 where solids generally larger than about 100 Tyler mesh are separated and recovered through a line 42 with the exhaust gas being passed through a line 43 to fine solids recovery section 27. Optionally, the gas recovered through line 43 could be passed to combustion chamber 23 for use in producing the hot gas required in dryer 19. The cooled dried coal is recovered through a line 44 and combined with the solids recovered from cyclone 41 to produce a dried coal product. The tendency of such dried low rank coals to spontaneously ignite is inhibited greatly by cooling such coals after drying.

In the improved method of this invention, the dried coal product is contacted with the special deactivating oil composition previously described in mixing zone 45. The special deactivating oil composition is introduced through line 46 and intimately mixed with the cooled dried coal in mixing zone 45 to produce a coal product, recovered through line 47, which has a reduced tendency to spontaneously ignite under normal storage and transportation conditions.

As shown, dried coal is mixed with a special deactivating oil composition after cooling; but it should be understood that the dried coal can be mixed with the special deactivating oil at higher temperatures before cooling although it is believed that normally the mixing is preferably at temperature no higher than about 200° F. (93° C.).

While coal gas alone may be used in cooler 37, improved cooling is accomplished in cooler 37 by the use of water injection as set forth in U.S. patent application, Ser. No. 333,145 entitled "Improved Process For Cooling Particulate Coal" by Bernard F. Bonnecaze filed of even date herewith and owned by a common assignee. The water is added through a line 48 and a spray system 49 immediately prior to passing the dried coal into cooler 37 or through a spray system 50 which adds the water to the dried coal immediately after injecting the coal into cooler 37. Either or both types of systems may be used. The amount of water added is only that amount required to achieve the desired cooling of the dried coal by evaporation. The water is sprayed onto the coal. The spray is controlled to an amount such that the added water is substantially completely evaporated from the coal prior to discharge of the cooled dried coal via line 44. In many areas of the country, relatively dry air is available for use in such cooling applications. For instance, in Wyoming, a typical summer air condition is about 90° F. (32° C.) dry bulb temperature and about 65° F. (18° C.) wet bulb temperature. Such air is very suitable for use in the cooler as described. While substantially any cooling gas could be used, the gas used will normally be air. Air is injected in an amount sufficient to fluidize or semi-fluidize the dried coal moving along grate 38 and in an amount sufficient to prevent the leaking of water through grate 38. The flow is further controlled to a level such that the velocity above the coal on grate 82 is insufficient to entrain any liquid water in the exhaust stream flowing to cyclone 41. Such determinations are within the skill of those in the art and need not be discussed in detail since the flow rates will vary depending upon the amount of cooling required.

In a further variation, water may in some instances be introduced as a fine mist beneath grate 38 via a spray system 51 and carried into the coal moving along grate 38 with the cooling gas. In such instances, similar considerations apply, and only that amount of water is added which is required to accomplish the desired temperature reduction in the coal on grate 38.

When relatively dry air is available, it may be desirable in some instances to use evaporative cooling outside cooler 37 to produce a cooled air stream for use in cooling the dried coal in cooler 37.

In the operation of dryer 19, the discharge temperature of the dried coal is typically from about 130 to about 250° F. (54° to 121° C.) and is preferably from about 190° to about 220° F. (88° to 104° C.). The residence time is chosen to accomplish the desired amount of drying and is readily determined experimentally by those skilled in the art based upon the particular type of coal used and the like. For instance, when drying subbituminous coal, an initial water content of about 30 weight percent is common. Desirably, such coals are dried to a water content of less than about 15 weight percent and preferably from about 5 to about 10 weight percent. Lignite coals often contain in the vicinity of about 40 weight percent water and are desirably dried to less than about 20 weight percent water with a range from about 5 to about 20 weight percent water being preferred. Brown coals may contain as much as, or in some instances even more than about 65 weight percent water. In many instances, it may be necessary to treat such brown coals by other physical separation processes to remove portions of the water before drying is attempted. In any event, these coals are desirably dried to a water content of less than about 30 weight percent and preferably to about less than 5 to 20 weight percent. The determination of the residence time for such coals in dryer 19 may be determined experimentally by those skilled in the art for each particular coal. The determination of a suitable residence time is dependent upon many variables and will not be discussed in detail.

The discharge temperature of the dried coal from dryer 19 is readily controlled by varying the amount of coal fines and air burned so that the resulting hot gaseous mixture after combustion is at the desired temperature. Temperatures should be controlled to avoid initiating spontaneous combustion of the coal. Suitable temperatures for many coals are from 250° to about 950° F. (104° to 570° C.).

In the operation of cooler 37, the temperature of the dried coal charged to cooler 37 in the the process shown is typically that of the dried coal discharged from dryer 19 less process heat losses. The temperature of the dried coal is desirably reduced in cooler 80 to a temperature below about 100° F. (38° C.) and preferably below about 80° F. (27° C.). The residence time, amount of cooling air, cooling water and the like may be determined experimentally by those skilled in the art. Such determinations are dependent upon the amount of cooling required and the like. As well known to those skilled in the art, after drying, coals are very susceptible to spontaneous ignition and combustion upon storage, in transit or the like. While such is the case, it is highly desirable that coals be available for use more widely than is possible at the present. The original moisture content of some coals results in excessive shipping costs, due at least in large measure to the excessive amount of water which is subject to freight charges and similarly results in lower heating (BTU) values for the coals since a substantial portion of the coal is water rather than combustible carbonaceous material. The lower heating value results in a limited use for the coals since many furnaces are not adapted to burn such lower BTU coals. By contrast, when the water content is reduced, the heating value is raised since a much larger portion of the coal then comprises combustible carbonaceous material. As a result, it is highly desirable that some coals be dried prior to shipment and that the tendency of dried coals to spontaneously ignite be reduced.

Accordingly, in the method of this invention, sometime after the dried coal particles are removed from dryer 19, the coal particles are contacted with the special deactivating oil composition previously described. The special oil composition may be used in any suitable quantity; but between 0.5 to 4.0 gallons of special oil per 2000 pounds of dried coal will usually be adequate.

Figure 2:
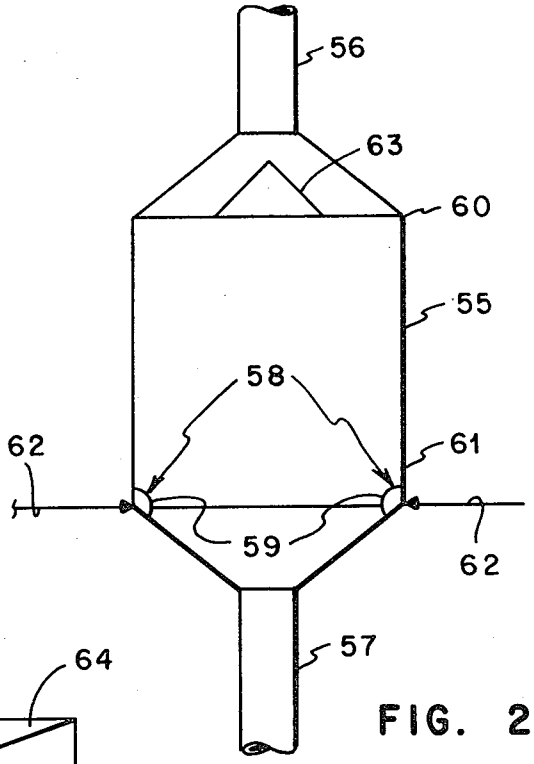
FIG. 2 is a schematic diagram of an apparatus for use in contacting particulate dried coal with the special oil composition of this invention.

The intimate mixing of the dried coal and deactivating oil is readily accomplished in a vessel such as shown in FIG. 2. Such a vessel and a method for intimately contacting particulate coal and a deactivating fluid are set forth in U.S. patent application, Ser. No. 333,144 entitled "Method and Apparatus for Contacting Particulate Coal and a Deactivating Fluid" by James L. Skinner and J. David Matthews filed of even date herewith and owned by a common assignee. In FIG. 2, the dried coal product or oxidized dried coal is charged to a contacting vessel 55 through a line 56 with the contacted coal being recovered through a line or discharge 57. In contact vessel 55, the special deactivating oil is maintained as a finely divided mist by spraying hot deactivating oil into vessel 55 through spray hot mist injection means 58 which, as shown in FIG. 2, are nozzles 59. Clearly, vessel 55 can be of a variety of configurations, and any reasonable number of mist nozzles 59 can be used. It is, however, necessary that the residence time between the upper end 60 of contacting vessel 55 and the lower end 61 of vessel 55 be sufficient that the coal is intimately contacted with the special deactivating oil as it passes through vessel 55. The deactivating oil is injected into vessel 55 through lines 62 which supply nozzles 59 using hot air to atomize the oil. Optionally a diverter 63 may be positioned to disrupt the flow of the coal to facilitate contact with the deactivating fluid.

Figure 3:
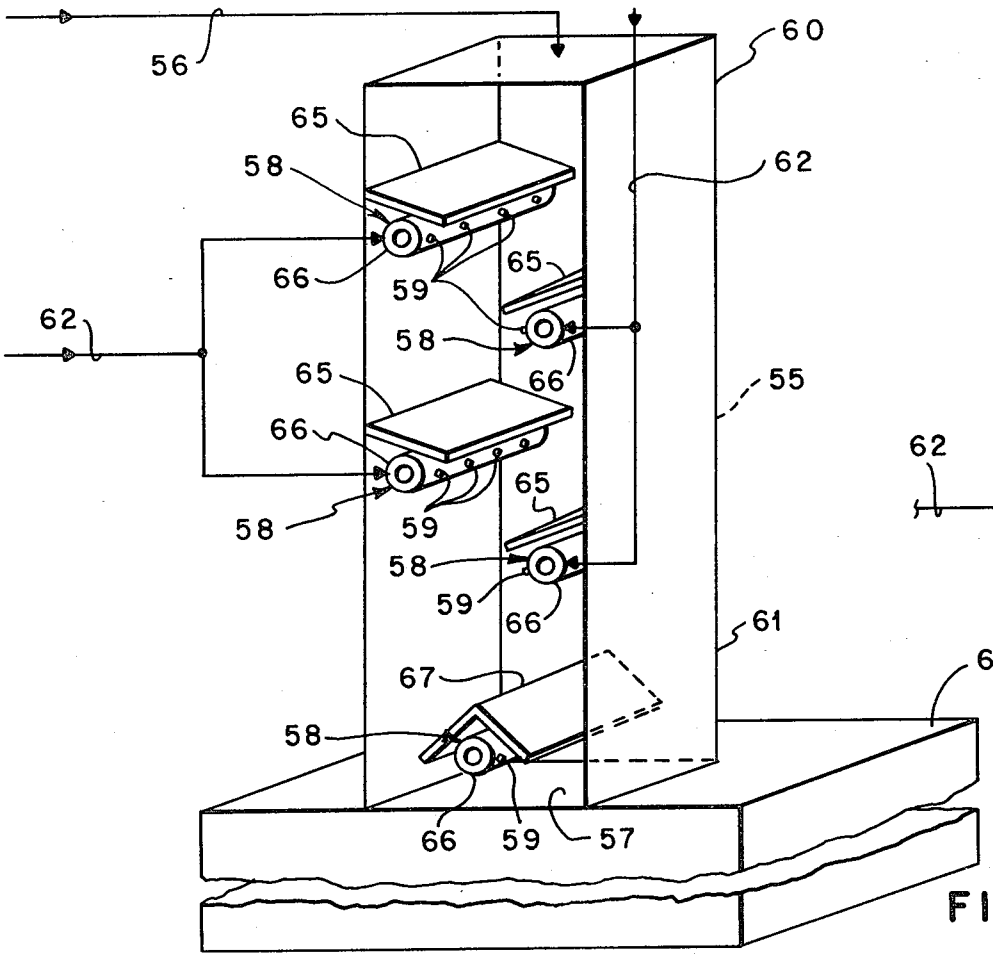
FIG. 3 is a schematic diagram of a further embodiment of an apparatus for use in contacting particulate dried coal with the special deactivating oil composition.

A further embodiment of a suitable contacting vessel is shown in FIG. 3. The contacting vessel shown in FIG. 3 is positioned on a storage hopper 64 and includes on its inner walls a plurality of projections 65, which serve to break up the smooth fall of particulate coal solids through vessel 55 thereby facilitating intimate contact of the particulate solids with the deactivating fluid mist present in vessel 55. Projections 65 may be of substantially any effective shape or size. Mist injection means 58 as shown in FIG. 3 comprise tubes 66 positioned beneath projections 65. Tubes 66 include a plurality of mist injection nozzles 59. Further, a deflector 69 is provided near lower end 61 of vessel 55 to further deflect the stream of particulate coal solids as they are discharged from vessel 55. A tube 66 including mist nozzles 59 is positioned beneath deflector 67.

In the operation of the vessels shown in FIGS. 2 and 3, a particulate coal stream is introduced into the upper portion of the vessels 55 and passes downwardly through vessel 55 by gravity flow in continuous contact with a finely divided mist of special deactivating oil. The residence time is highly variable depending upon the size of the stream passed through vessel 55 the presence or absence of projections in vessel 55 and the like. The contact time and amount of mist are adjusted to obtain a desired quantity of special deactivating oil in intimate mixture with the dried coal.

The deactivating oil of this invention may be preceded by an additional step for reducing the tendency of the dried coal to spontaneously ignite. A controlled oxidation step may be supplied after the coal drying operation and prior to cooling the dried coal. A method and apparatus for oxidizing such coal is set forth in U.S. patent application, Ser. No. 333,143 entitled "Method and Apparatus for Oxidizing Dried Low Rank Coal" by Donald K. Wunderlich filed of even date herewith and owned by a common assignee.

The foregoing description of the conditions and variables of the process illustrates a preferred method of conducting the process and how the special deactivating oil composition coacts with the drying stage to accomplish the advantages and objectives herein set forth.

Reasonable variations and modifications are practical with the scope of this disclosure without departing from the spirit and scope of the claims of this invention. For example, the selection of the particular process will be dependent to a large extent upon the particular coal feed stock used. It may also be dependent on the amount of dust suppression needed. Another variable which may affect the choice of the process for a particular coal is the risk involved upon spontaneous ignition. For instance, it may be desirable to over-treat dried coal products which are to be shippped by sea or the like in view of the substantially greater risk of damage upon spontaneous ignition that would be the case for coals which are to be stacked near a coal-consuming facility. A multitude of considerations will affect the particular process chosen; however, it is believed that the particular combination of steps set forth will be found effective in the treatment of substantially any coal especially low rank coals, to produce a dried fuel product which has a reduced tendency toward spontaneous ignition.

The embodiments of the invention in which an exclusive property or privilege is claimed are defined as follows:

1. In a method for producing a dried particulate coal fuel having a reduced tendency to spontaneously ignite wherein crushed mined coal is heated in a drying zone with a hot gas to vaporize water from the coal and dry the coal to a moisture content of less than about 20 percent by weight of water and wherein the dried coal is removed from said drying zone, the improvement comprising spraying and intimately mixing said removed dried coal particles with virgin vacuum reduced crude with a 5% point in excess of 900° F., a characterization factor at least as high as 10.8, and a flash point at least as high as 400° F., whereby dried coal particles are contacted with deactivating oil composition to produce a coal product which has a reduced tendency to spontaneously ignite under normal storage and transportation conditions.

2. The method of claim 1 wherein said crushed mined coal is selected from the group consisting of sub-bituminous, lignite, brown coals and combinations thereof.

3. The method of claim 2 wherein said crushed mined coal is heated to a temperature from about 130° F. to about 250° F. in said coal drying zone.

4. The method of claim 1 wherein said removed dried coal is sprayed with about 0.5 gallon to about 2 gallons of said virgin reduced crude.

5. The method of claim 1 wherein said removed dried coal is cooled to a temperature below 100° F. before said removed dried coal is sprayed with said virgin reduced crude.

6. The method of claim 1 wherein the coal is dried to a moisture content of between 5 and 20 percent by weight of water.

* * * * *